United States Patent [19]

Wiethoff

[11] 4,123,866

[45] Nov. 7, 1978

[54] MUZZLE-LOADING HANDGUN

[75] Inventor: Günter Wiethoff, Solingen, Germany

[73] Assignee: Firma Cuno Melcher KG ME-Sportwaffen, Solingen, Germany

[21] Appl. No.: 786,426

[22] Filed: Apr. 11, 1977

[30] Foreign Application Priority Data

Apr. 10, 1976 [DE] Fed. Rep. of Germany ... 7611322[U]

[51] Int. Cl.[2] ..... F41C 21/10

[52] U.S. Cl. ..... 42/77; 42/51; 42/83

[58] Field of Search ..... 42/77, 51, 83

[56] References Cited

U.S. PATENT DOCUMENTS

| | | | |
|---|---|---|---|
| 960 | 10/1838 | Adams | 42/77 |
| 72,063 | 12/1867 | McCulloch | 42/77 |
| 282,194 | 7/1883 | Howe | 42/77 |
| 640,070 | 12/1899 | Aeschbacher | 42/77 |
| 1,127,268 | 2/1915 | Malster | 42/77 |
| 1,226,443 | 5/1917 | Baker | 42/51 |
| 1,517,328 | 12/1924 | Weiss | 42/77 |
| 1,759,772 | 5/1930 | Williams | 42/77 |
| 2,150,914 | 3/1939 | Gaidos | 42/77 |

FOREIGN PATENT DOCUMENTS

| | | | |
|---|---|---|---|
| 1,043 of | 1863 | United Kingdom | 42/83 |

*Primary Examiner*—Charles T. Jordan
*Attorney, Agent, or Firm*—Karl F. Ross

[57] ABSTRACT

To reduce the caliber of a muzzle-loading handgun, an inner barrel is inserted into the normal, outer barrel to which it is positively fastened only at the muzzle end. The rear end of the inner barrel adjoins a nipple, screwed into the breech portion of the outer barrel, which has a rearwardly projecting boss adapted to carry a percussion cap lodged in a recess of a hammer when the latter is uncocked. The nipple has a bore offset from or inclined to the barrel axis to reduce the reaction of the explosive charge upon the hammer when the percussion cap is detonated. The inner barrel fits tightly into the outer barrel in the vicinity of the nipple but is of reduced diameter over the greater part of its length for easier insertion.

11 Claims, 3 Drawing Figures

MUZZLE-LOADING HANDGUN

Figures 1, 1A, 1B:
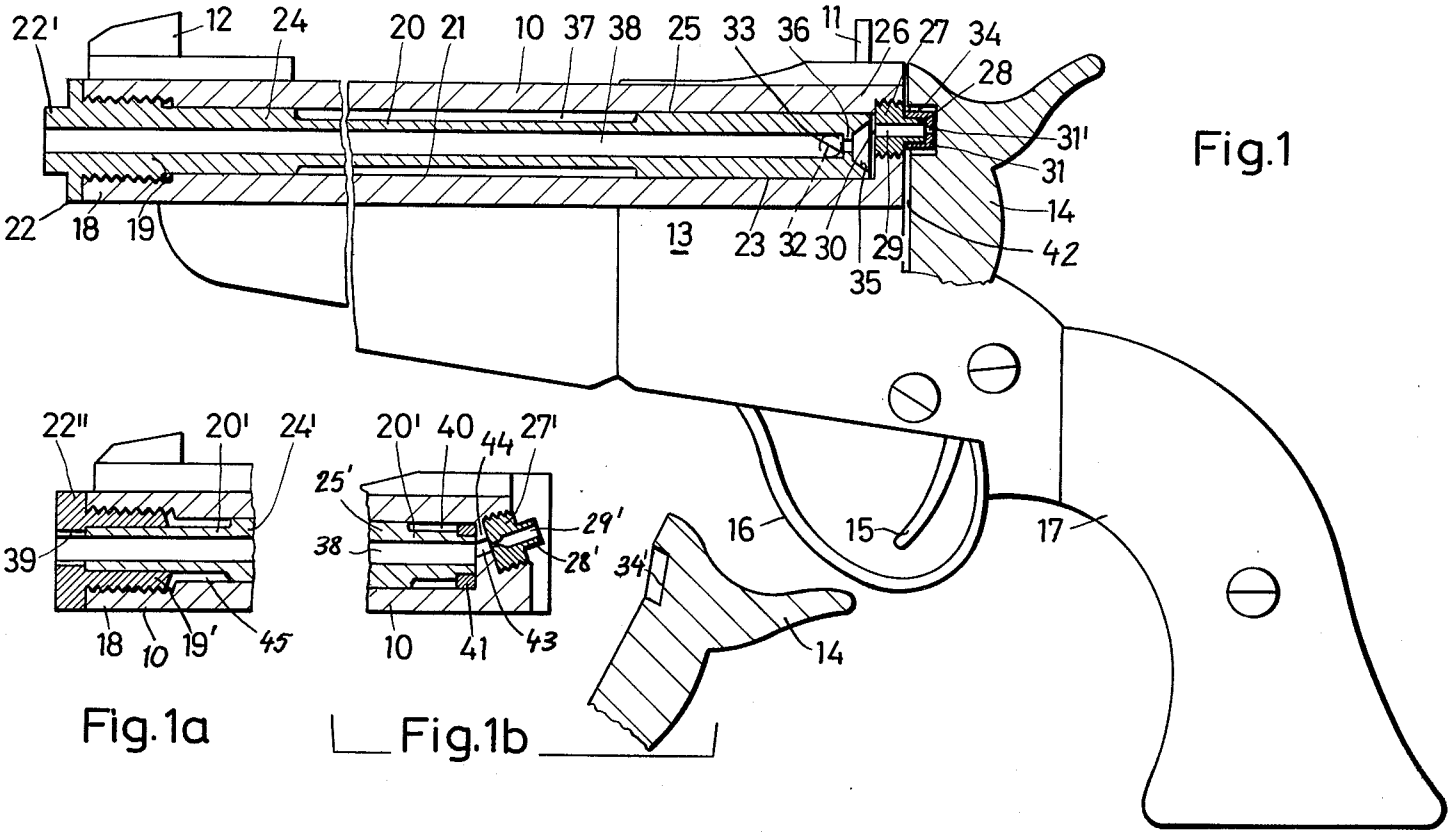

My present invention relates to a handgun of the muzzle-loading type adapted to fire bullets or other projectiles, with or without propulsive charges, of a caliber smaller than that for which it is originally designed.

Thus, the object of my invention is to provide simple means for reducing the caliber of such a handgun while maintaining a high firing accuracy even with ammunition launched merely by the detonation of a percussion cap.

I realize this object, in accordance with my present invention, by the provision of an inner barrel with a reduced-caliber bore inserted into an outer barrel rigid with the gunstock of the firearm, the inner barrel being provided at its muzzle end with fastening means positively engageable with the front end of the outer barrel while being tightly fitted at a rear part into a breach portion of that outer barrel, this rear part forming a seat for a projectile loaded through the muzzle end. A percussion cap is engageable by retaining means provided between a nipple, secured to the breech portion of the outer barrel adjacent the rear end of the inner barrel, and a hammer forming part of the firing mechanism, a throughgoing passage of this nipple communicating with the bore of the inner barrel via an aperature present in a transverse wall of either the inner or the outer barrel defining the projectile seat.

Advantageously, in order to facilitate the insertion of the inner barrel into the outer one as well as its extraction therefrom, the outer diameter of the inner barrel is less than the inner diameter of the outer barrel over the major portion of the length of that inner barrel, i.e. between a closely fitting forward part of that inner barrel (at or near its muzzle end) and the aforementioned rear part thereof. The forward part of the inner barrel may form an externally threaded head screwed into the correspondingly threaded front end of the outer barrel; alternatively, a separate threaded sleeve can be used to secure the muzzle end of the inner barrel to the front end of the outer barrel.

According to a further feature of my invention, the retaining means for the percussion cap comprises a rearward extension of the nipple receivable in a recess of the hammer when the latter is in its normal, uncocked position. The recess not only keeps the percussion cap in place, ready for firing, but also prevents it from mushrooming during detonation with wasteful escape of part of its explosion charge. Naturally, the hammer must have a certain play which allows the bottom of its recess to strike the percussion cap with sufficient force to detonate that cap when the trigger is pressed.

The above and other features of my invention will now be described in detail with reference to the accompanying drawing in which:

FIG. 1 is a side-elevational view, partly in section, of a handgun embodying my invention;

FIG. 1*a* is a fragmentary sectional view of the muzzle of the handgun shown in FIG. 1, illustrating a modification; and FIG. 1*b* is a fragmentary sectional view of the breech of the handgun of FIG. 1, modified according to FIG. 1*a*, with the hammer of its firing mechanism shown in cocked position.

The firearm shown in FIG. 1 has a main or outer barrel 10, rigid with its gunstock 13, carrying the usual rear and front sights 11 and 12. Gunstock 13 is provided with a pistol grip 17 and carries a hammer 14 which can be cocked with the aid of a nonillustrated sear and released by the pressing of a trigger 15 surrounded by the usual trigger guard 16.

The front end 18 of barrel 10 is internally threaded to mate with an externally threaded head 19 at the muzzle end of an inner barrel 20 of smaller caliber; head 19 has a collar 22, coming to rest against the front end 18 of barrel 10, and a forward extension 22′ of hexagonal or other noncircular outline engageable by a wrench for tightly securing the inner barrel 20 to the outer barrel 10 or disengaging it therefrom.

Head 19 terminates rearwardly in an unthreaded neck 24 fitting closely into the outer barrel 10. Beyond that neck, and over the greater portion of its length, barrel 20 has an outer diameter which is less than the inner diameter of barrel 10 so as to form an annular clearance 37 therewith. At a rear part 25, inner barrel 20 is received with a tight fit in the outer barrel 10 to form a seal 23 against the escape of combustion gases when the weapon is fired in the manner described hereinafter; the fit between neck 24 and barrel 10 need not be quite so tight. The presence of clearance 37 enables full insertion of barrel 20, to the extent determined by its collar 22, even if some combustion residue should have accumulated in the breech portion 26 of barrel 10.

A partition 36 at the rear end 25 of inner barrel 20, having an aperture 33, defines a site for a projectile 32 — here shown as a bullet — which is loaded into the bore 38 of barrel 20 through the muzzle end thereof. Beyond partition 36 the bore 38 is widened into a frustoconical port 35 which together with aperature 33 forms part of a channel for the guidance of combustion gases into the bore 38. Port 35 communicates with a central passage or bore 29 in a nipple 27 which is threaded into the breach portion 26 of outer barrel 10 and has a rearward extension or boss 28 serving as a retainer for a percussion cap 31 carrying an explosive charge 31′. Cap 31, which can be placed on boss 28 when the hammer 14 is withdrawn into its cocked position illustrated in FIG. 1*b*, fits into a cylindrical recess 34 of that hammer. Hammer 14 is normally separated from breech portion 26 by a small gap 42 which allows the hammer to swing forwardly past its normal position of FIG. 1, upon its release from the cocked position shown in FIG. 1*b*, under the force of its nonillustrated biasing spring; the impact of the bottom of recess 34 upon the percussion cap 31 then sets off its charge 31′ to fire the bullet 32 from barrel 20.

The axial passage 29 of nipple 27 is shown offset from the axis of barrels 10 and 20 for the purpose of reducing the reaction exerted upon hammer 14 by the explosive charge. For the same purpose I have shown in FIG. 1*b* a nipple 27′ inclined to the barrel axis, the central passage or bore 29′ of that nipple communicating with barrel bore 38 via a channel 43 in an end wall 44 of outer barrel 10 here defining a seat for a projectile such as bullet 32. FIGS. 1*a* and 1*b* also show a modified inner barrel 20′ which, instead of being fixed in position by a collar 22 as illustrated in FIG. 1, rests with its rear end against the transverse front face of end wall 44 whose rear face converges in the upward direction toward that front face at an angle corresponding to the inclination of nipple 27′. The muzzle end of barrel 20′ abuts a shoulder 39 of a sleeve 19′ resting with a collar 22″ against the front end 18 of outer barrel 10; collar 22″ may be polygonally profiled for engagement by a wrench. Barrel 20′ has a thickened forward portion 24', separated from sleeve 19' by a space 45, which fits closely into the outer barrel 10; a rear part 25' of barrel 20' tightly fits into the breech portion of barrel 10 to form a vapor seal. Part 25' is separated from end wall 44 of barrel 10 by a reduced extremity of barrel 20', leaving an annular clearance 40 between the two barrels; a sealing ring 41 fitted onto that extremity is in contact with end wall 44 and with the inner periphery of barrel 10.

The bore 29' of nipple 27' is narrowed toward the aperture 43 and the bore 38 to concentrate the combustion gases entering that passage upon detonation of the charge 31' of percussion cap 31 (FIG. 1); such a convergence could also be provided in the nipple bore 29 of FIG. 1. In view of the inclination of the boss 28' of nipple 27', serving as a holder for a percussion cap, the bottom of a corresponding recess 34' of hammer 14 has been shown similarly inclined.

The insertion of an inner barrel 20 or 20', pursuant to my present invention, allows the owner of the handgun to engage in indoor target practice, for example, without impairing the ability of the weapon to fire larger-caliber projectiles which may be cartridges carrying their own propulsive charges to be ignited by the detonation of a percussion cap or by direct impact from the hammer, e.g. through the intermediary of a firing pin replacing the nipple 27 or 27'. Such cartridges could also be loaded into the breech portion of barrel 10 by a conventional ammunition clip.

I claim:

1. A handgun comprising:

a gunstock provided with an outer barrel and a firing mechanism including a hammer rearwardly of said outer barrel, said outer barrel having an apertured end wall;

an inner barrel with a reduced-caliber bore inserted into said outer barrel, said inner barrel having a muzzle end provided with fastening means positively engageable with a front end of said outer barrel, said inner barrel further having a rear part tightly fitted into a breech portion of said outer barrel, said rear part adjoining a rear extremity of said inner barrel having an outer diameter less than the inner diameter of said outer barrel, said end wall forming a seat for a projectile loaded through said muzzle end;

a sealing ring on said extremity in contact with said end wall;

a nipple secured to said breech porition adjacent said rear part; and retaining means for a percussion cap between said nipple and said hammer, said nipple forming a throughgoing passage communicating with said bore.

2. A handgun as defined in claim 1 wherein said passage is offset from the axis of said bore.

3. A handgun as defined in claim 2 wherein said seat is separated from said passage by a channel formed in a transverse wall of one of said barrels.

4. A handgun as defined in claim 3 wherein said transverse wall is an apertured partition in said bore, said channel including an enlarged part of said bore rearwardly of said partition.

5. A handgun as defined in claim 3 wherein said transverse wall is an end wall of said outer barrel having a front face perpendicular to the axis of said bore and a rear face converging in an upward direction toward said front face, said nipple resting against said rear face.

6. A handgun comprising:

a gunstock provided with an outer barrel and a firing mechanism including a hammer rearwardly of said outer barrel;

an inner barrel with a reduced-caliber bore inserted into said outer barrel, said inner barrel having a muzzle end provided with fastening means positively engageable with a front end of said outer barrel, said inner barrel further having a rear part tightly fitted into a breech portion of said outer barrel, said rear part forming a seat for a projectile loaded through said muzzle end;

a nipple secured to said breech portion adjacent said rear part; and retaining means for a percussion cap between said nipple and said hammer, said nipple forming a throughgoing passage communicating with said bore and offset from the axis thereof, said seat being separated from said passage by a channel which is formed in a transverse wall of one of said barrels constituting an apertured partition in said bore, said channel including an enlarged part of said bore rearwardly of said partition.

7. A handgun as defined in claim 6 wherein said retaining means comprises a rearward extension of said nipple, said hammer having a recess receiving said extension with clearance in an uncocked hammer position.

8. A handgun as defined in claim 6 wherein said inner barrel has a forward part closely fitting into said outer barrel, the outer diameter of said inner barrel being less than the inner diameter of said outer barrel betweeen said forward part and said rear part.

9. A handgun as defined in claim 6 wherein said fastening means comprises a threaded head integral with said inner barrel screwed into the front end of said outer barrel and provided with a collar resting against said front end.

10. A handgun as defined in claim 6 wherein said fastening means comprises a threaded sleeve screwed into the front end of said outer barrel and provided with a collar resting against said front end, said sleeve having an internal shoulder bearing upon said muzzle end.

11. A handgun comprising:

a gunstock provided with an outer barrel and a firing mechanism including a hammer rearwardly of said outer barrel;

an inner barrel with a reduced-caliber bore inserted into said outer barrel, said inner barrel having a muzzle end provided with fastening means positively engageable with a front end of said outer barrel, said inner barrel further having a rear part tightly fitted into a breech portion of said outer barrel, said rear part forming a seat for a projectile loaded through said muzzle end;

a nipple secured to said breech portion adjacent said rear part; and retaining means for a percussion cap between said nipple and said hammer, said nipple forming a throughgoing passage communicating with said bore and offset from the axis thereof, said seat being separated from said passage by a channel which is formed in a transverse end wall of said outer barrel, said end wall having a front face perpendicular to the axis of said bore and a rear face converging in an upward direction toward said front face, said nipple resting against said rear face.

* * * * *